US006185847B1

(12) United States Patent
Russell et al.

(10) Patent No.: US 6,185,847 B1
(45) Date of Patent: Feb. 13, 2001

(54) CONTINUOUS SHOVEL

(75) Inventors: Matthew F. Russell; Gerald Kaschmitter, both of Spokane, WA (US)

(73) Assignee: R. A. Hanson Company, Inc., Spokane, WA (US)

( * ) Notice: Under 35 U.S.C. 154(b), the term of this patent shall be extended for 0 days.

(21) Appl. No.: 08/932,748

(22) Filed: Sep. 17, 1997

(51) Int. Cl.[7] ..... E02F 3/52

(52) U.S. Cl. ..... 37/401; 37/395; 37/93; 198/588; 299/18

(58) Field of Search ..... 37/462, 463, 359, 37/73, 96, 398–401, 394, 395, 396, 397; 198/594, 588; 299/13, 57, 67, 64, 56

(56) References Cited

U.S. PATENT DOCUMENTS

| | | | | |
|---|---|---|---|---|
| 1,576,910 | * | 3/1926 | Hudson | 198/588 X |
| 2,796,999 | * | 6/1957 | Russell | 198/588 X |
| 3,251,449 | | 5/1966 | Hoppmann . | |
| 3,297,141 | | 1/1967 | Janitsch et al. . | |
| 3,334,759 | | 8/1967 | Ludwig . | |
| 3,687,276 | * | 8/1972 | Pelletier | 198/588 X |
| 3,722,477 | * | 3/1973 | Weldy et al. | 198/588 X |
| 3,746,150 | * | 7/1973 | Briggs | 37/359 X |
| 4,150,853 | * | 4/1979 | McCoy | 299/18 |
| 4,206,840 | | 6/1980 | Hanson . | |
| 4,890,720 | * | 1/1990 | Brais | 299/67 X |
| 4,979,781 | * | 12/1990 | Bothwell et al. | 299/18 |
| 5,214,866 | * | 6/1993 | Hackmack | 37/93 X |
| 5,234,094 | * | 8/1993 | Weyermann et al. | 198/588 X |
| 5,364,171 | | 11/1994 | Addington et al. . | |
| 5,575,538 | * | 11/1996 | Gilbert et al. | 37/96 X |
| 5,609,397 | * | 3/1997 | Marshall et al. | 299/67 |

* cited by examiner

*Primary Examiner*—Victor Batson
(74) *Attorney, Agent, or Firm*—Wells, St. John, Roberts, Gregory & Matkin, P.S.

(57) ABSTRACT

The present invention discloses a method and apparatus for excavating material from a mining or reclamation operation, and is generally considered useful in open cast mining operations. The apparatus has a first conveyor and a second conveyor attached to a chassis. The first conveyor is fitted with a material remover such as a excavator bucket on a first end. Material discharges from the first conveyor onto a second conveyor which is generally longitudinally aligned with the first conveyor and has a material receiving point located elevationally below the discharge point of the first conveyor. The first conveyor is moved in a forward direction by a crowder which consists of motion generally along the coincident longitudinal axes of the two conveyors. The first end of the first conveyor which is fitted with the excavating bucket is elevationally moved by virtue of a boom and cable configuration.

41 Claims, 12 Drawing Sheets

CONTINUOUS SHOVEL

TECHNICAL FIELD

This invention pertains to method and apparatus for earth moving, and in particular to an apparatus used in open pit mining and in reclamation in post mining operations. More particularly, the invention pertains to a continuous excavator and more particularly to a continuous bucket-type or shovel excavator.

BACKGROUND OF THE INVENTION

Many applications require large quantities of earthen material to be moved from one location to another. Primary examples include removing overburden in a mining operation, or removing coal from a coal mine in an open cast or pit mine. Post-mining reclamation efforts also require large quantities of earthen material to be moved, primarily replacement of overburden in open cast mining operations and topsoil on top of the replaced overburden. Other examples of large scale earth moving operations include sand and gravel mining, as well as moving large quantities of earth to fill marshy areas and the like for future development or farming efforts.

Examples of equipment which have been used in the past for large earth moving operations, particularly open cast mining operations, include the drag line which is popular in open pit mining in the United States. Other types of known apparatus include the bucket wheel excavator which has a large rotating wheel extended at the end of a boom, wherein the wheel has a plurality of buckets disposed on its outer periphery which remove earth from the face of an open pit mine and deposit it onto a conveyor belt. In bucket wheel excavators, the boom supporting the bucket wheel may move from side to side or in a generally vertical direction. Bucket wheel excavators are among the largest machines known to man. As would be expected, the price for such machines is proportional to the size of the machine.

Yet another example of prior art large scale earth moving equipment includes the shovel. Large shovels may extract significant volumes of earthen material in a single pass. However, ancillary equipment must be used in conjunction with the shovel to handle the single slug of earthen material which is discharged from the shovel. Such ancillary equipment may include hoppers for metering the material onto a conveyor belt or large dump trucks for moving the material from the excavation site to a processing site. Use of shovels results in an inherently discontinuous process and also requires expensive ancillary equipment such as the dump trucks and auxiliary hoppers and conveyors.

In such large scale earth moving operations, the earthen material must frequently be moved over large distances. Typically, this is accomplished by overland conveyors which may be a mile or more in length. Notwithstanding their long length, the overland conveyors are designed in segments, with each segment engineered to sustain the peak load anticipated on the conveyor belt spanning that particular section. The more weight which is anticipated to be carried by any given particular section of the overland conveyor, the more robust the conveyor will need to be, and consequently the more expensive will be the cost of building and maintaining the conveyor. When, in the earth moving operation, the earth is deposited on the overland conveyor in discontinuous or discrete quantities, peak loads will occur on the conveyor. The conveyor must therefore be designed to sustain the peak load, rather than the average load. It is therefore desirable to eliminate the peaks and provide a more continuous flow of material on the overland conveyor and thereby reduce the design requirements, and concomitantly the cost, of the conveyor.

Even bucket wheel excavators do not result in a truly continuous or even load of earthen material on conveyors. Solutions are to install a hopper system at the head of the overland conveyor and thereby distribute the material on the conveyor in an even manner. However, this adds additional cost to the earth moving operation.

Even when a hopper is provided at the head of the overland conveyor, in most operations an intermediate conveyor must be provided between the earth removing equipment and the hopper. Such intermediate conveyors may be several hundred feet or more in length, and it is therefore desirable, if possible, to reduce the load requirements for these intermediate conveyors as well.

What is therefore needed in the art is an earth removing machine which is inexpensive to purchase, operate and maintain, is relatively flexible in facilitating movement of the equipment from one location to another, and which provides a continuous flow of material to an overland conveyor system.

BRIEF DESCRIPTION OF THE DRAWINGS

Preferred embodiments of the invention are described below with reference to the following accompanying drawings.

FIG. 4 is a second sequential step showing the operation of the apparatus of the present invention as it is beginning to remove earthen material from the face of an exposed earth surface.

FIG. 5 is a third sequential step in the operation of the apparatus of the present invention showing the excavator as it is making a transition from horizontal to vertical excavation.

FIG. 7 shows a fifth sequential step in the operation of the excavator of the present invention showing the earth remover in a retracting position about to be repositioned to the position shown in FIG. 3.

FIG. 13 is a side sectional detail of a bucket-type earth remover which may be used with the excavator of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The present invention discloses a relatively small high capacity earth remover which may be configured to provide continuous flow of material to a conveyor which is or supplies an overland conveyor. The apparatus may be further configured to feed other material transport devices such as a truck, rail car, ship or the like. In yet another embodiment of the present invention, the apparatus may comprise a stationary or semi-stationary material transfer station where material may for example be removed from piles in which it is deposited by other equipment such as dump trucks or conveyors and transferred to another material moving device such as an overland conveyor. The present invention discloses novel methods for removing earth material in a continuous or semi-continuous manner.

Figure 1:
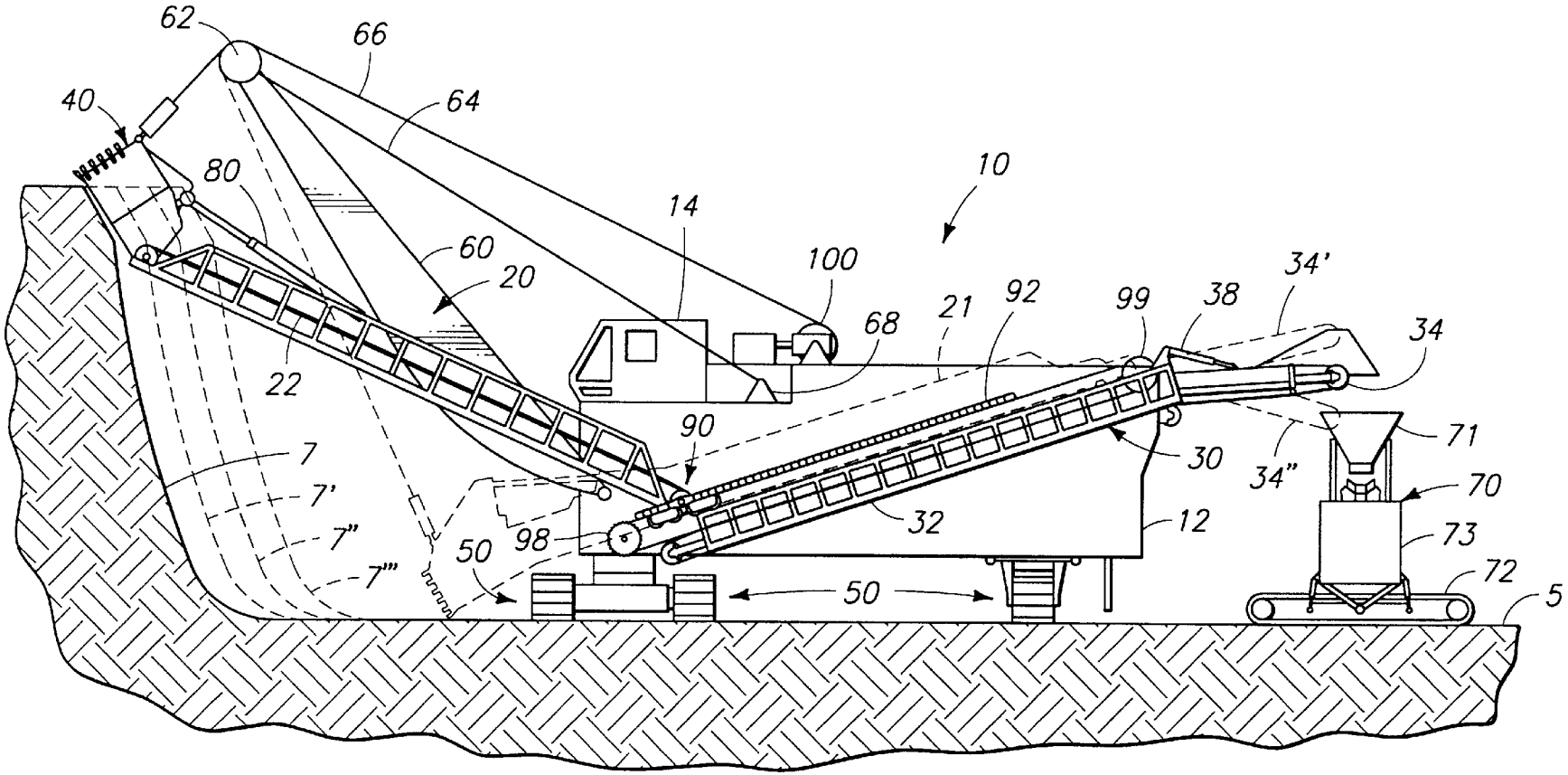
FIG. 1 is a general side elevational view of the excavator of the present invention.

Turning to FIG. 1, the apparatus 10 of the present invention is shown. The apparatus may generally be described as an excavator, and more particularly as a bucket-type excavator in certain implementations. In other implementations, the apparatus may be known as a continuous bucket-type excavator. The primary components of the apparatus comprise a first earthen material transport 20 which may alternately be known as a first conveyor or an arm conveyor; a second earth transport 30 which may also be known as second conveyor or first discharge conveyor; and an earth remover 40. First conveyor 20 and second conveyor 30 are preferably maintained in relative position to one another by chassis 12 of the excavator. More preferably, chassis 12 is mounted on movement mechanism 50 which may comprise movable support structures such as tracks or rails and the like. First conveyor 20 has a first end which may be engaged proximate to the exposed earth face or mine face 7. The second end of first material transport 20 is advantageously located elevationally proximate to, and engaged to move along the length of, second conveyor 30, and is more preferably urged in a generally forward direction against the exposed face 7 by first material transport drive 90, which is more particularly known as a crowder or crowder drive.

The first end of the first material transport 90 may be elevationally positioned via a first end positioner which may take the form of a boom and cable arrangement as shown by boom 60 and cable 66 in FIG. 1. Positioning of the first end of the arm conveyor 20 also affects the positioning of the earth remover 40. Earth remover 40 may also be independently positioned with an earth remover positioner 80 as will be more fully disclosed herein.

Figure 10:
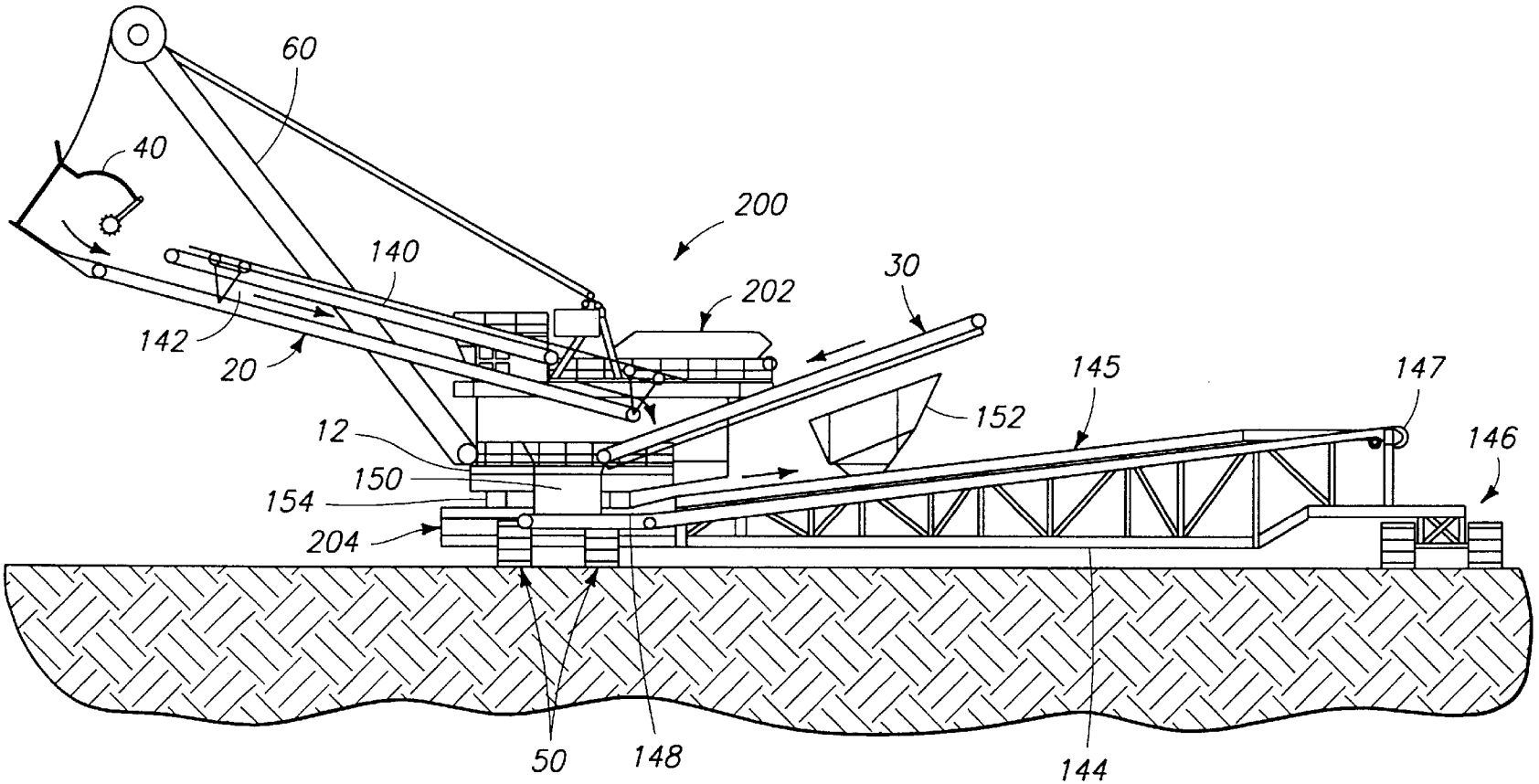
FIG. 10 is a side elevational view of an alternate embodiment of the excavator of the present invention showing the implementation of a third conveyor.
Figure 11:
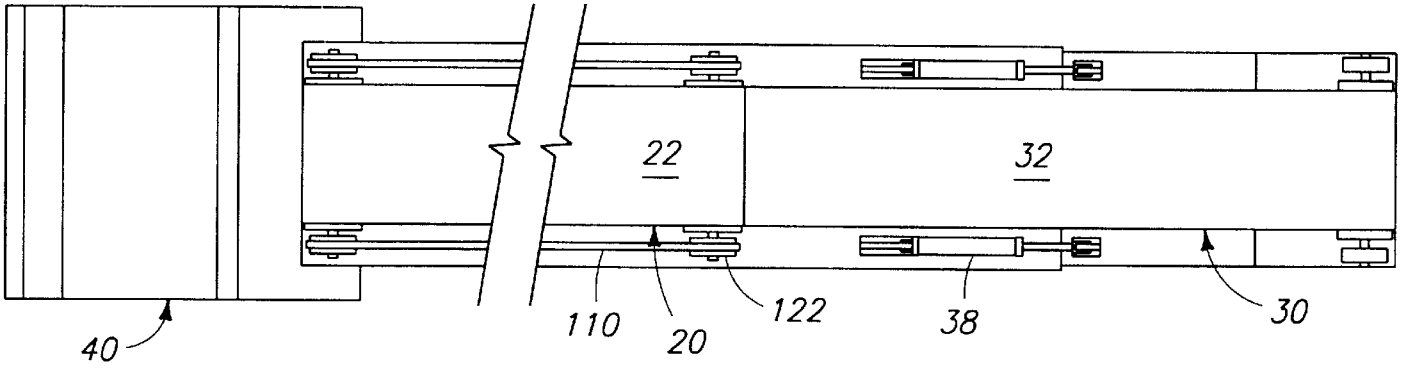
Figure 12:
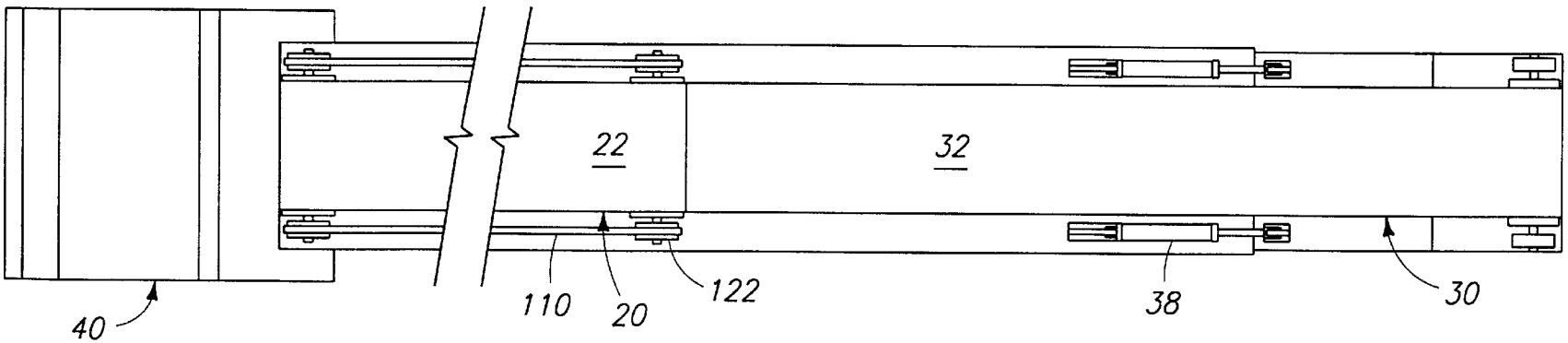
FIG. 12 is plan view of the upper and lower conveyors of the excavator of the present invention showing the upper conveyor in an extended position.
Figure 11:
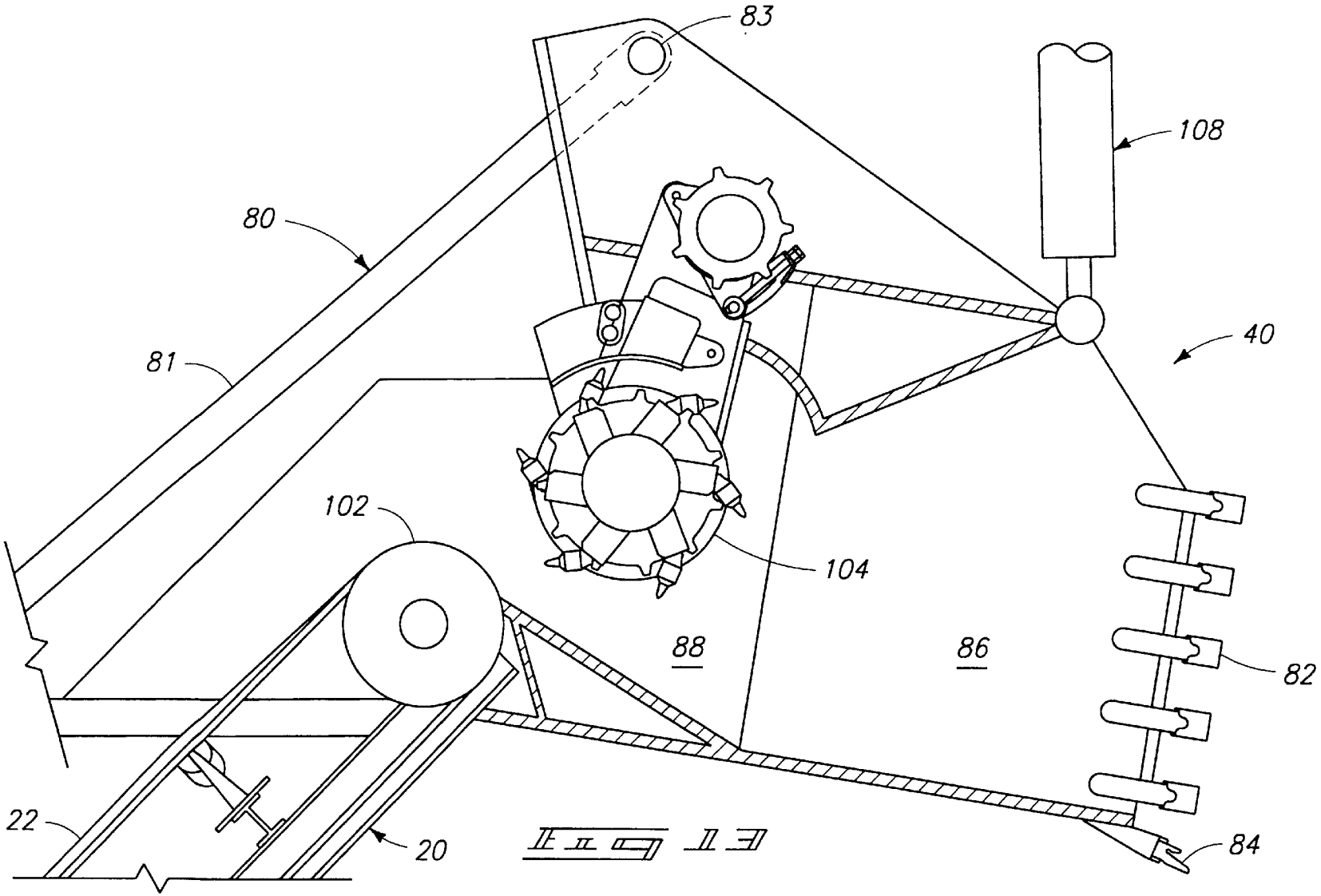

As material is removed by the earth remover 40, it is moved onto the first conveyor 20 where it moves downward to a point proximate to second conveyor 30. Material is discharged from the first conveyor 20 onto the second conveyor 30. Material may then be discharged from second conveyor 30 into an auxiliary material conveyor system such as material receiving station 70 shown in FIG. 1. More preferably, second conveyor 30 discharges material into a surge pocket 150 as shown in FIG. 10. The surge pocket then feeds third conveyor 145. In the three conveyor embodiment, the material discharged from third conveyor 145 is discharged in a continuous manner.

The method and apparatus of the present invention will now be described in particular detail.

Excavator Chassis

In the preferred embodiment of the invention, the various conveyors are preferably maintained in their relative positions by chassis 12 of excavator 10 as shown in FIG. 1. Providing chassis 12, and in particular with movement mechanism 50, allows the arrangement of conveyors to be easily relocated from one position to another. However, it will be appreciated that the various conveyors as will be further described herein may be maintained in their relative positions by a fixed structure. Certain applications may make a fixed structure more preferable than the chassis arrangement shown in FIG. 1. However, the relationship of the various conveyors, and their operation in conjunction with one another, will not be affected by the manner in which they are supported relative to one another.

The chassis preferably includes an operator cab 14 from which the equipment and operation of the apparatus may be controlled. The chassis 12 further supports other components useful in operating the various conveyors in conjunction with one another, as will be more fully described herein.

Figure 2:
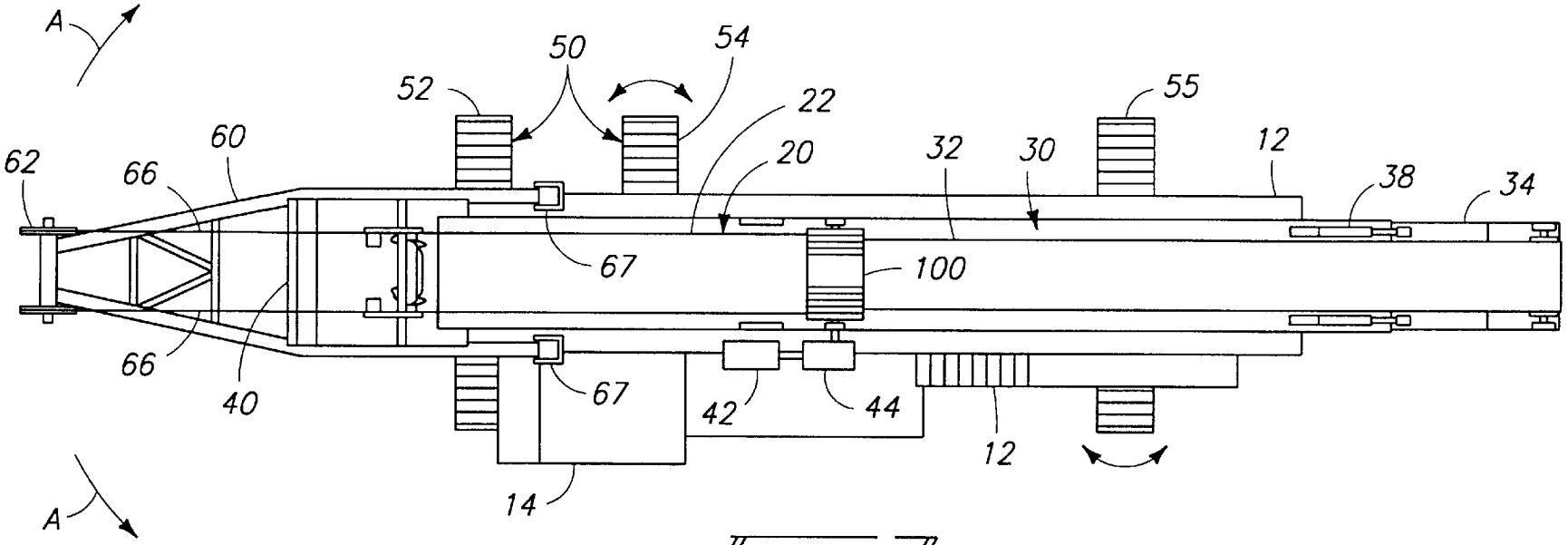
FIG. 2 is a plan view of the excavator of the present invention.

Turning to FIG. 2, a plan view of the apparatus is shown which shows one embodiment of how the conveyors may be arranged on such a chassis with respect to one another. In FIG. 2, the arm conveyor 20 is shown in a fully retracted position as would be the case shown by phantom lines 21 in FIG. 1. Returning to FIG. 2, it is seen that the arm conveyor 20 is preferably aligned with second conveyor 30 in elevationally offset relationship. That is, a longitudinal centerline running down the middle of arm conveyor belt 22 would lie in the same vertical plane as a longitudinal centerline running down the center of second conveyor belt 32.

Turning to FIG. 10, it will be seen that third conveyor 145 may further be supported by chassis 12 to provide an integral three conveyor unit which provides for continuous flow of removed earthen material.

As stated above, chassis 12 may advantageously contain all components necessary to operate the excavator as a single unit. Auxiliary components not shown might include a motor for moving the apparatus across the ground 5, a fuel source for such motor, an electrical generator for converting combustion engine power into electricity, as well as electronic control systems for facilitating operation of the apparatus.

Chassis 12 may be further provided with movement mechanisms 50 as shown in FIG. 1. Movement mechanisms 50 may comprise any known mechanisms for moving equipment over the ground, including the tracks or caterpillar treads shown in FIG. 1, rubber tires, metal wheels mounted on fixed rails, and crawler mechanisms. More preferably, the movement mechanism is steerable to allow the excavator 10 to be positionally relocated with respect to the ground surface 5 on which it rests.

Turning to FIG. 2, one embodiment of a track arrangement of steerable moving mechanisms is shown. The movement mechanism 50 comprises forward tracks 52 and 54 and a rearward track 55. In this instance, two forward tracks are provided to more evenly distribute the weight of the excavator on the ground. Depending on the conditions expected to be encountered by the excavator, it may be desirable to provide greater or lesser contact area between the tracks and the ground. A greater contact area will allow the weight to be distributed over a larger area as may be required where soft ground is encountered. On the other hand, narrower tracks may be desirable to allow easier steering of the tracks with respect to the ground due to the reduced surface area contact and hence reduced friction.

In the apparatus shown in FIG. 2, tracks 52 and 54 are connectably steerable such that pivotal steering motion of one track works in conjunction with the second track. It is possible however that tracks 52 and 54 may be independently steerable of one another. In the apparatus shown in FIG. 2, where tracks 52 and 54 are independently steerable of track 55, tracks 52 and 54 may be rotated to cause the apparatus to pivot about track 55. Once such pivoting has moved the apparatus to a first position, tracks 52 and 54 may be repositioned and track 55 pivoted to allow the apparatus to pivot about the mid-point between tracks 52 and 54. Once the apparatus has performed such secondary pivoting, it would be seen that the apparatus has moved translationally. Further means for moving the apparatus would include rotating both tracks 52 and 54 and track 55 at 90 degrees from the positions indicated in FIG. 2. The apparatus would then be capable of translating in a left and right position with respect to the orientation shown in FIG. 2.

Steerable motion of the tracks may be accomplished by hydraulic actuators or any other mechanisms for moving large earth movement mechanisms.

Arm Conveyor

The excavator 10 of the present invention advantageously includes an arm conveyor 20. The arm conveyor 20 is alternately known as the first conveyor as it is the first conveyor to receive material from the material remover 40. While generally described as a conveyor herein, arm conveyor 20 is more generally known as a material transport system. While in the preferred embodiment the first conveyor 20 has a continuous conveyor belt 22 for moving material along its length, the material transport may alternately employ a series of buckets linked together on a chain, or other continuously or semi-continuously earth conveying means.

Arm conveyor belt 22 is driven by conveyor drive mechanisms which are well known in the art. The first conveyor drive belt 22 is preferably configured such that in cross section, it forms a shallow U which will prevent the migration of material off of the conveyor belt. The conveyor belt may be fabricated from any material which is common in conveying earthen material, the selection of which may vary depending on the particular earthen material to be conveyed.

The arm conveyor 20 is preferably provided with an earth remover 40 at a first end. The earth remover 40 will be more fully described below. At a second end, the arm conveyor 20 is positioned and supported to enable selective positioning of the first conveyor second end at different longitudinal locations along the second conveyor 30. The particular details and operation of the supporting mechanism allowing such selective positioning between the two conveyors will be more fully described below.

The arm conveyor 20 is further connected to a crowder 90. The particular details of the crowder will be more fully described below. The function of the crowder is to urge the first conveyor in a generally forward direction relative to the second conveyor. Such urging provides a force against the exposed earth face 7 allowing the earth remover 40 to more efficiently remove earth therefrom.

At the end opposite from the crowder 90, the arm conveyor is provided with an elevational positioning mechanism which will be described more fully below, but in the present embodiment is shown as the boom 60 and positioner cable 66 configuration shown in FIG. 1.

Operation of the crowder 90 and the arm conveyor first end positioner allow a range of movement which is shown in FIG. 1 wherein the arm conveyor 20 may move from the position shown by phantom lines 21 to the extended position shown in the figure. It will be appreciated that by independently operating the crowder 90 from the first end positioner 66, the arm conveyor 20 may also be driven into the ground when the first end positioner is not used (i.e., the cable is not under tension) to elevationally alter the position of the earth remover 40. Such operation may be useful, for example, where it is desired to excavate material below grade.

In viewing FIGS. 1 and 2 in conjunction, it is seen that earthen material moving from conveyor 20 will be discharged onto second conveyor 30, which will have a receiving point located elevationally directly below the discharge point of the arm conveyor 20.

Figure 9:
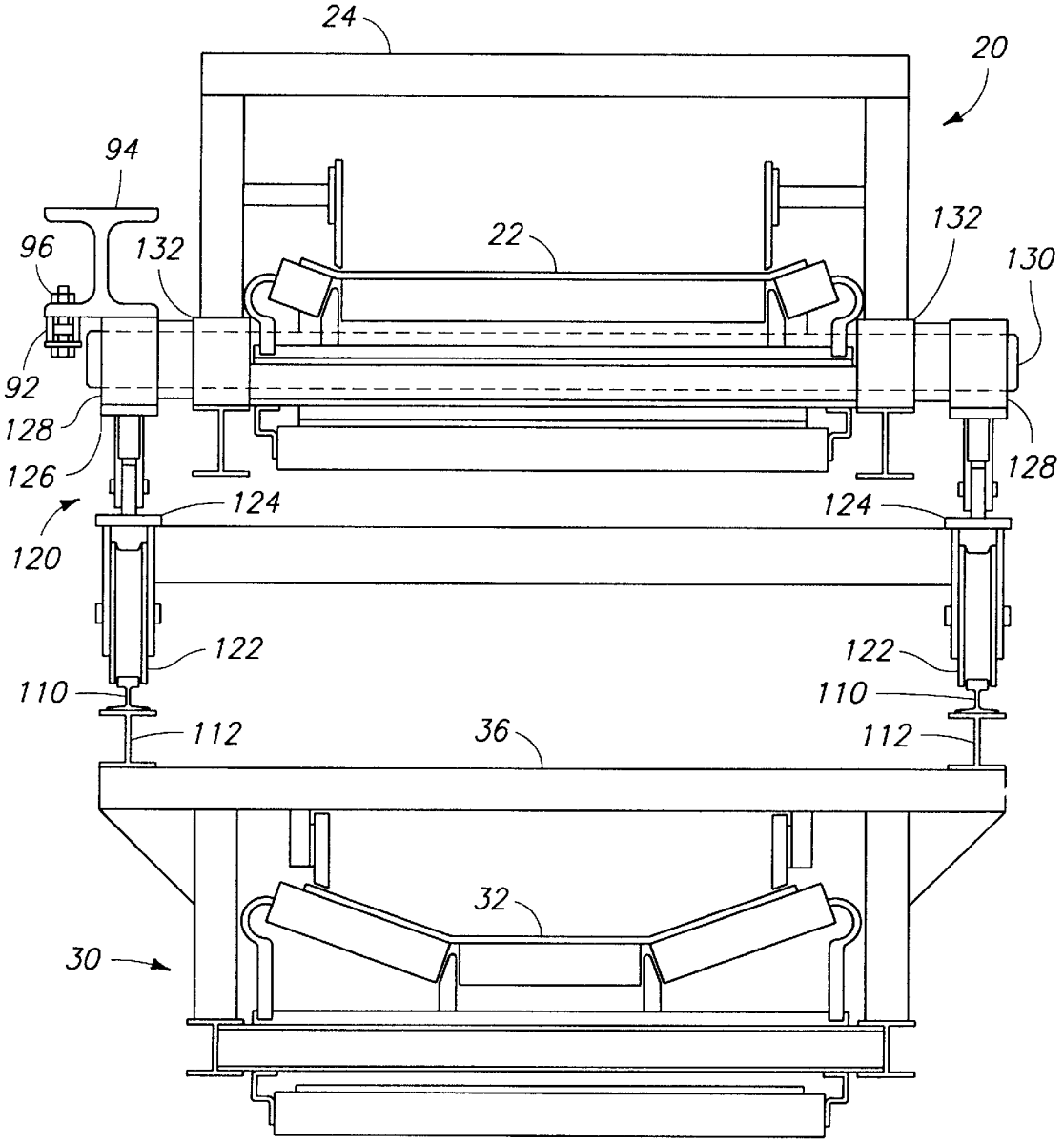
FIG. 9 is a sectional elevational view of the upper and lower conveyors of the excavator showing the component allowing relative motion therebetween.

Arm conveyor 20 is preferably provided with a support frame 24 as shown in FIG. 9 which will add structural stability and strengthening to the conveyor. Because of the large amount of material which may be required to be supported on the conveyor at any given time, it is advantageous to build a rigid structure to avoid failure of the structure under heavy loads.

Figure 6:
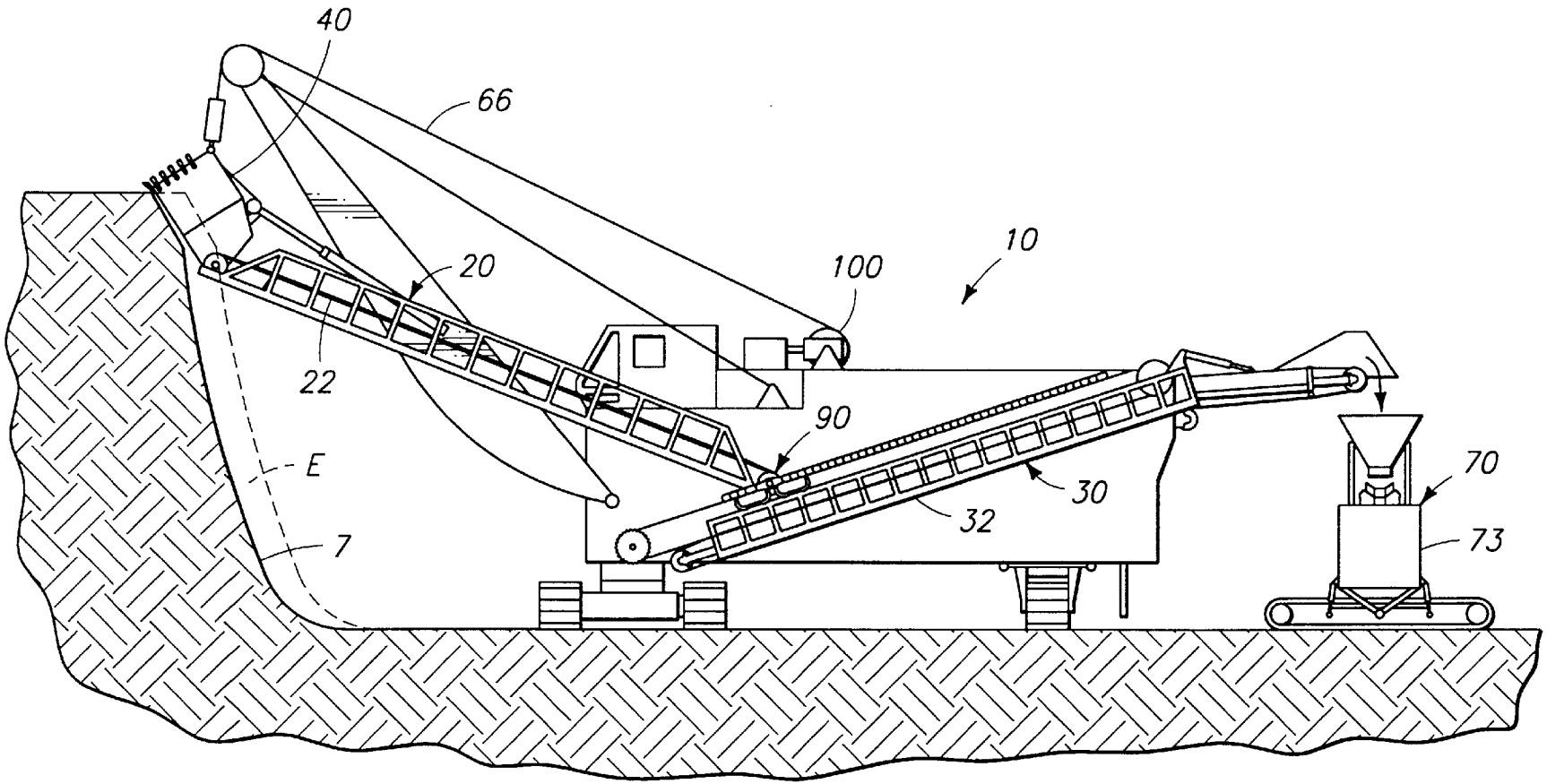
FIG. 6 is a fourth sequential step in the operation of the excavator of the present invention showing the earth remover as it has completed its excavation of the earthen material exposed face.
Figure 11:
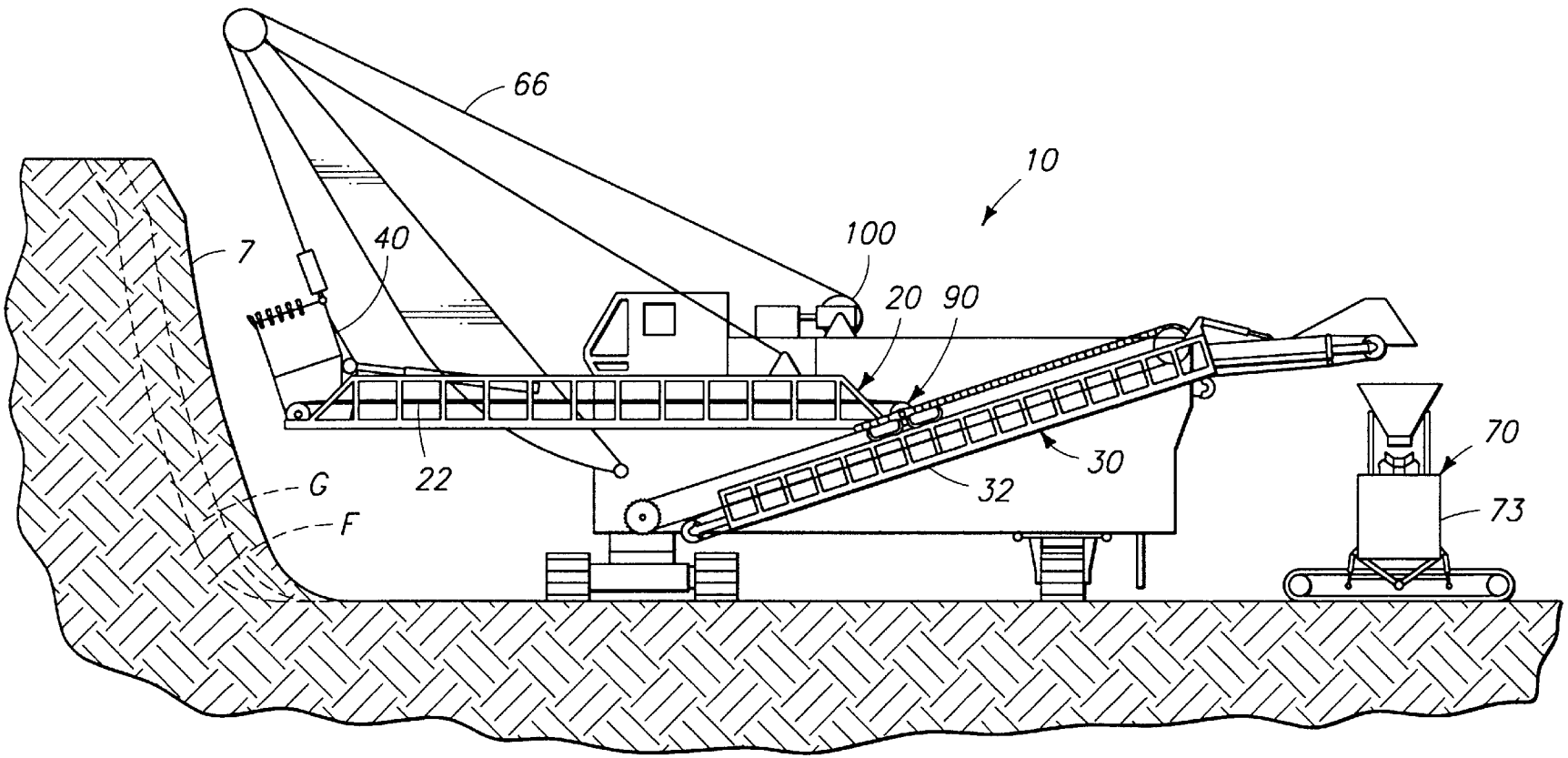

In an alternate embodiment of the present invention, the arm conveyor may be configured with an auxiliary overlay conveyor 140 such as is shown in FIG. 10. The overlay conveyor 140 is preferably disposed above and longitudinally aligned with the arm conveyor 20. The overlay conveyor may be supported by the same frame structure which is used to support the arm conveyor. Between the arm conveyor 20 and the overlay conveyor 140 is formed a material channel 142. Material exiting from the material remover or bucket 40 passes into the material channel 142. The material channel 142 acts like a choke, tending to control the material flow rate which may be provided by arm conveyor 20 to second conveyor 30. Controlling the material flow rate of removed material which may be handled by arm conveyor 20 has two benefits: firstly, it tends to provide a more even weight load on both the arm conveyor 20 and the second conveyor 30, thereby limiting the design requirements for these conveyors as discussed earlier; and secondly, when arm conveyor 20 is elevated at a maximum extension such as shown in FIG. 6, material may tend to cascade down the arm conveyor faster than the arm conveyor belt itself moves in the absence of the overlay conveyor. The material channel controls the amount of material which may pass down the arm conveyor, reducing the tendency of large quantities of material to cascade onto the secondary conveyor 30.

First Discharge Conveyor

Returning to FIG. 1, first discharge conveyor 30 is shown. The first discharge conveyor may alternately be known as the second material transport or the second conveyor. As was described above for the arm conveyor 20, it is not necessary that the second material transport 30 necessarily be a conventional conveyor, and may be configured otherwise depending on the particular earth removing operation which is intended to be performed.

First discharge conveyor 30 is preferably supported by chassis 12 in fixed position with respect to chassis 12. However, it may be desirable that either end of second conveyor 30 be selectively positionable relative to chassis 12. Such might be the case for example where various discharge elevations are encountered. As shown in FIG. 1, second conveyor 30 may discharge earthen material from the adjustable discharge end 34, which may be elevationally positioned as shown by the phantom lines 34' and 34" above and below the adjustable discharge end 34. The adjustable discharge may be elevationally moved for example by discharge section positioners 38, which are also shown in plan view in FIG. 2. Elevational variation of the adjustable discharge end may be desired where for example the elevational height of the chute 71 of the material receiving station 70 may vary.

In one embodiment, the second conveyor 30 may discharge its material from a discharge end into a separate material receiving station 70 as shown in FIG. 1. Material receiving station 70 comprises a chute 71 for receiving material, a hopper 73 for holding material, and conveyor 72 for moving material off site. It will be appreciated that material receiving station 70 is auxiliary to and independent of the excavator 10. In an alternate embodiment shown in FIG. 10, the first discharge conveyor 30 will operate to move the material in the direction opposite that shown in FIG. 1, discharging the material into surge pocket 150. Further operation of the embodiment shown in FIG. 10 will be described below. However, it should be appreciated that second conveyor 30 may be operated to move material in either direction on second conveyor belt 32.

Third Conveyor

Turning to FIG. 10, an embodiment of the present invention further comprising a third conveyor 145 is shown. The third conveyor is preferably attached to the chassis 12 of the apparatus 200 providing an integral three conveyor system. When a third conveyor is used, the excavator 200 is preferably provided with a surge pocket 150. Surge pocket 150 receives material from secondary conveyor 30 and then discharges material onto third conveyor 145. Surge pocket 150 thusly provides a capacitance in the system thereby providing an even rate of delivery of material to third conveyor 145. Third conveyor 145 therefore then provides a continuous flow of material at discharge point 147, thereby making the apparatus 200 a continuous excavator.

Third conveyor 145 may further be provided with oversized hopper 152. Oversized hopper 152 is further provided with a crusher (not shown) for crushing large size objects such as rocks and the like. In operation, when the material remover 40 receives a rock or other large piece of earthen material which may not be broken up by the earth remover itself, the equipment operator may pivot the upper structure 202 about the lower structure 204 of the apparatus 200 and dump the oversized earth material from earth remover 40 into oversized hopper 152. Pivoting of upper structure 202 about lower structure 204 may be accomplished by pivotal mounting platform 154, which may be driven by powered means and mounted on bearings to provide smooth operation, as is known in the art of designing and fabricating earth handling equipment.

Third conveyor 145 may further be provided with second discharge moving mechanism 146. Second discharge moving system 146 may comprise tracks or other means for mobilely moving equipment over the ground. Second discharge moving mechanism 146 may operate in conjunction with the movement mechanism 50, which is mounted on lower structure 204, to allow movement of the entire apparatus 200. Additionally, second discharge conveyor 145 may be pivotally attached to the lower structure 204 of the apparatus 200 to allow the second discharge conveyor 145 to rotate about the lower structure 204 of the apparatus 200. Second discharge conveyor 145 may additionally be pivotally hinged at its attachment point to lower structure 204 to allow elevational differences between third conveyor tracks 146 and primary excavator tracks 50.

First Material Transport and Earth Remover Positioning

The first material transport or arm conveyor 20 has for reference purposes a first end fitted with earth remover 40 and a second end fitted with crowder drive 90. In the preferred embodiment, the first end may be elevationally positioned ("luffed") independent of the location of the second end of the arm conveyor. Such elevational positioning may be accomplished by an apparatus such as is shown in FIG. 1. The arm conveyor bucket end position system shown comprises an arm conveyor positioner cable 66 which is supported by a boom pulley 62 and boom 60 which is attached to chassis 12 of the excavator 10. The arm conveyor positioner cable 66 is preferably attached to the bucket 40 which is itself attached to the arm conveyor 20 thereby providing the positioning capability of the arm conveyor by the arm conveyor positioner cable 66. At its other end, arm conveyor positioner cable 66 is attached to arm conveyor positioner winch 100 which is shown in plan view in FIG. 2. As seen in FIG. 2, the arm conveyor is more preferably provided with two arm positioner cables 66 for strength and stability. The arm positioner winch 100 is preferably driven by arm positioner gearbox 44 which is itself driven by arm positioner motor 42. By unwinding cable 66 from the arm positioner winch 100, the first end of the arm conveyor 20 may be raised and lowered as can be seen in the sequential FIGS. 3 through 7, which will be described in further detail below.

The earth remover or bucket 40 is itself preferably positioned by an independent bucket positioner 80. The bucket positioner 80 shown in FIG. 1 consists of a hydraulic cylinder which is attached to a pivotal connection point on the upper end of the bucket. Turning to FIG. 13, the details of the bucket are shown in cross section. The hydraulic ram 81 of the bucket positioner 80 is shown, as well as the pivotal positioner connection 83. At a lower end of the bucket, the bucket is pivotally attached to the arm conveyor 20 by bucket arm pivot connection 102. Positioning of the bucket is best demonstrated by comparing FIGS. 3, 4, and 5 wherein the bucket is shown rotating through an angle of approximately 140 degrees. It will be appreciated that the bucket positioner 80 and arm positioner cable 66 may work independently of each other, as is best demonstrated in sequential FIGS. 3 through 6.

The second end of arm conveyor 20 distal from earth remover 40 is advantageously positioned elevationally above and along the second discharge conveyor 30. While in the embodiment of the invention shown and described herein, the elevational position of the second end of arm conveyor 20 is maintained a constant distance away from the second discharge conveyor 30, it may be desirable in a particular application to allow the second end of the arm conveyor to be elevationally positionable independent of the position of the second discharge conveyor 30. Such positioning may be accomplished for example by use of hydraulic rams. For example, turning to FIG. 9 which shows a cross section of the arm conveyor 20 with respect to the first discharge conveyor 30, the rail support beams 112 may be replaced with or suspended upon hydraulic rams. Such would allow the elevational position of the second end of arm conveyor 20 to be varied with respect to the first discharge conveyor 30.

Figure 11:
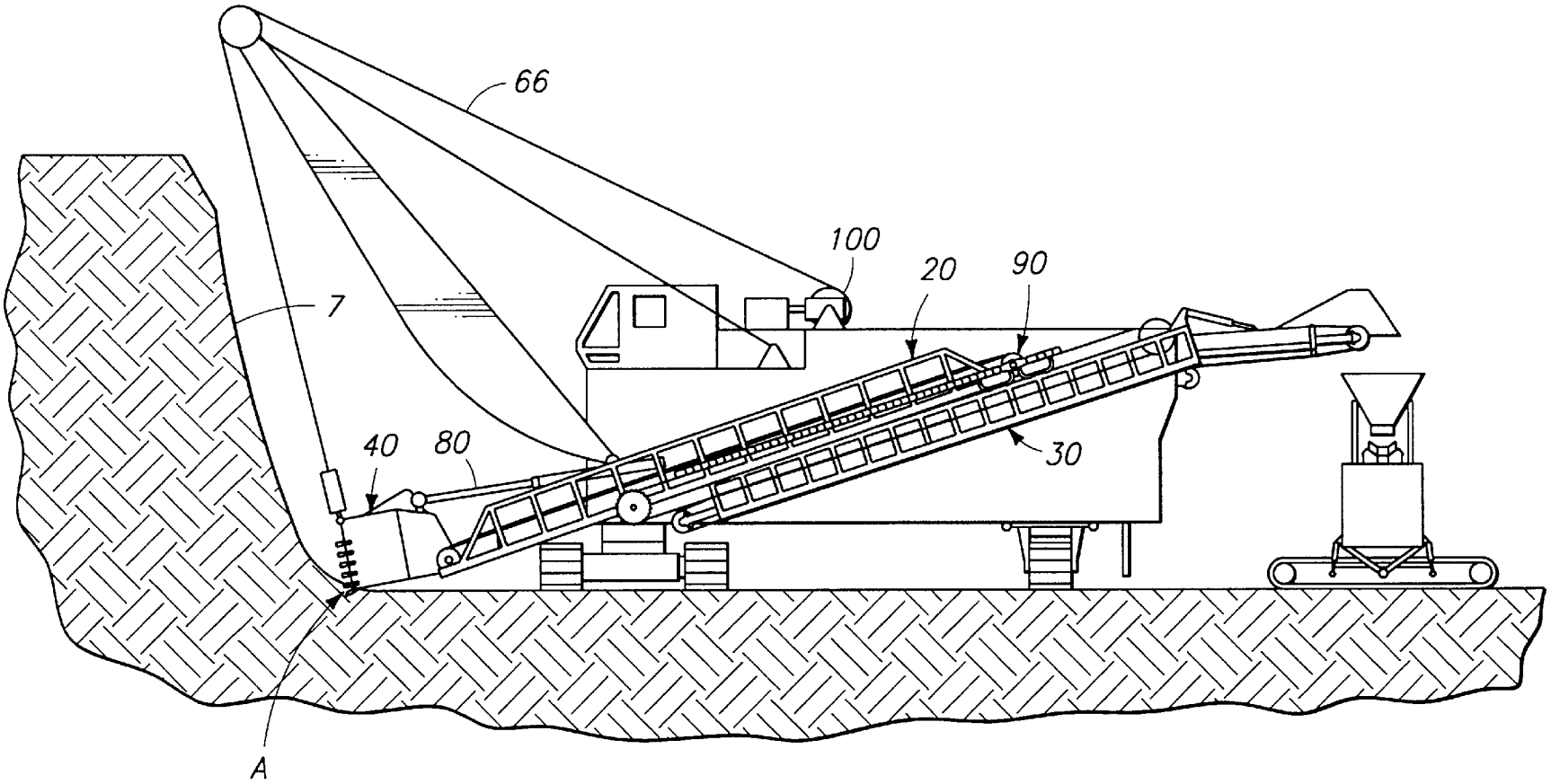
FIG. 11 is a plan view of the upper and lower conveyors of the present invention showing the upper conveyor in a retracted position.
Figure 11:
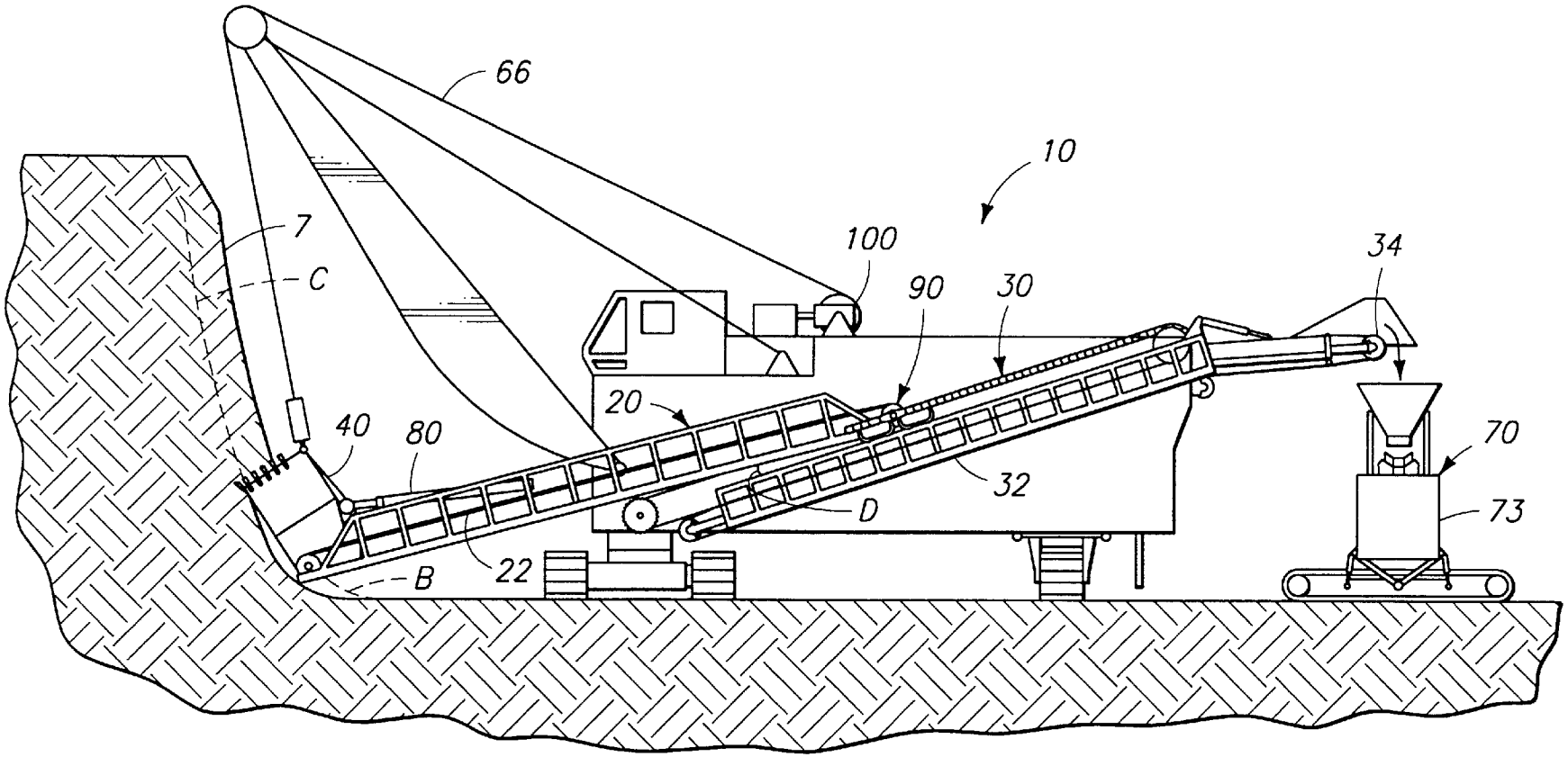

In the embodiment shown in FIG. 1 and described herein, the second end of arm conveyor 20 is slidably mounted on bearing surfaces disposed either side and longitudinally aligned with the first discharge conveyor 30. Such arrangement is shown in detail in FIG. 11, wherein the arm conveyor 20 is supported on wheels 122 which ride along rails 110 which a redisposed either side of first discharge conveyor 30.

Turning to FIG. 9, a mechanism which allows relative movement of the second end of the arm conveyor 20 with respect to the first discharge conveyor 30 is shown in cross sectional detail. Arm conveyor 20 is mounted on wheels 122 which are then placed on rails 110 which are mounted on rail support beams 112 which are supported on the upper portion of the discharge conveyor frame 36. Wheels 122 are mounted in carriages 124 as is shown in side elevational detail in FIG. 8. In the embodiment shown, four wheels 122 are supported by rails 110 about either side of the discharge conveyor belt 32. Carriages are pivotally mounted to carriage mounting bracket 126 thus providing a support configuration which may be described as a "bogie" which is a term of art commonly used to describe the wheel and carriage arrangement shown and described.

Returning to FIG. 9, the upper flange of the carriage mounting bracket 126 is rigidly attached to an arm conveyor shaft journal 128. Arm conveyor shaft journal 128 supports arm conveyor mounting shaft 130. Arm conveyor 20 is pivotal with respect to arm conveyor shaft 130 by virtue of arm shaft bearings 132.

Figure 8:
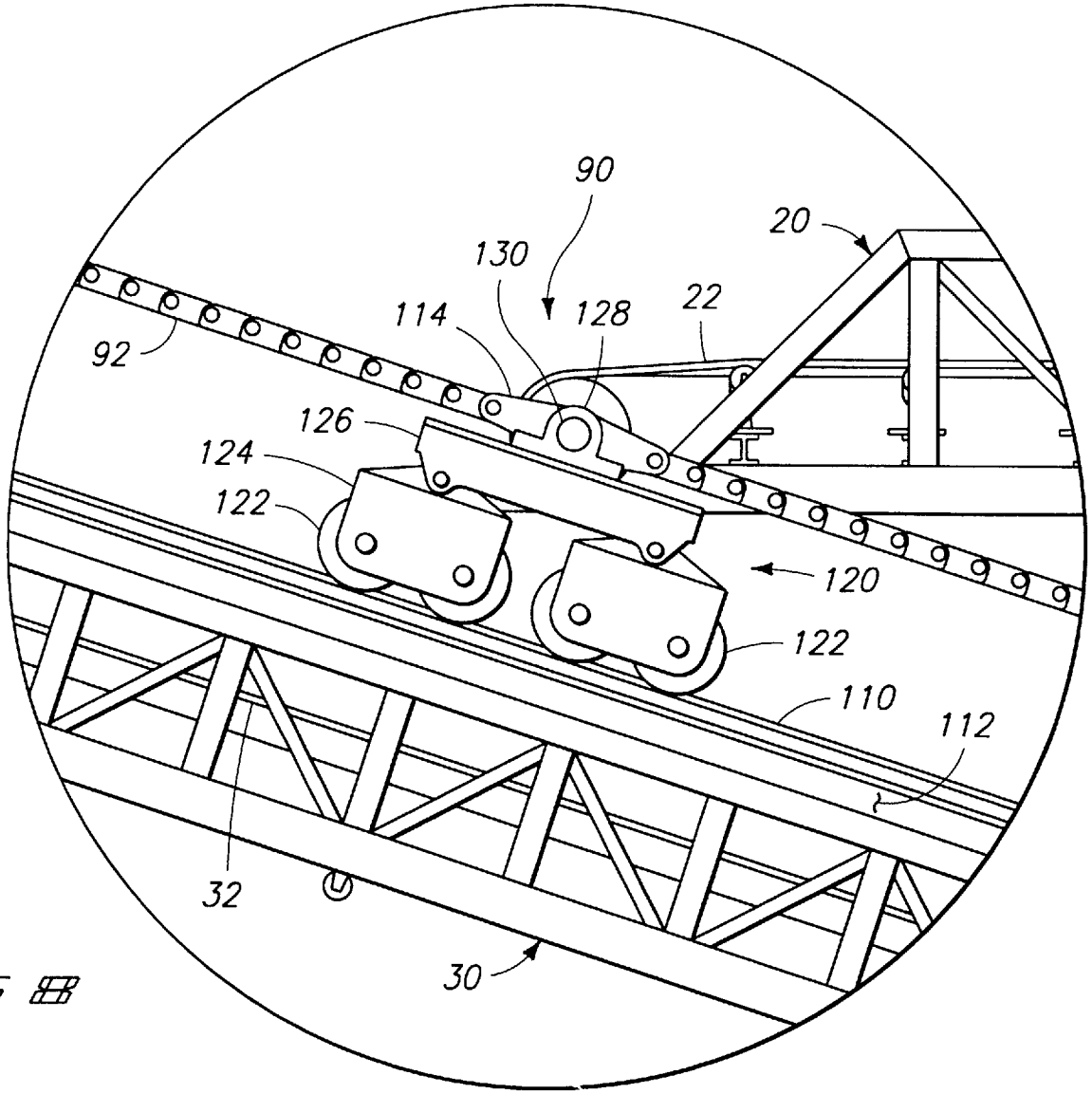
FIG. 8 is a side elevational view showing the point of contact between the upper and lower conveyors of the excavator of the present invention and the crowder drive connection with the upper conveyor.

As was described earlier, arm conveyor 20 is driven in a forward direction towards the exposed earth face 7 as shown in FIG. 1 by the crowder 90. In the embodiment shown and described herein, crowder 90 is a chain driven mechanism. The crowder chain 92 of FIG. 8 is driven by the crowder drive sprocket 98 of FIG. 1. Crowder chain 92 makes a complete loop and wraps around crowder follower sprocket 99. In FIG. 1, only a portion of crowder drive chain 92 is shown for the sake of simplifying the figure. Crowder drive sprocket 98 may be driven by any known means for driving a chain drive, such as an electric motor and transmission, hydraulic actuators, or combustion engine power-take-off.

Turning now to FIG. 8, the connection between the crowder drive chain 92 and the arm conveyor 20 is shown in one embodiment. In the embodiment shown in FIG. 8, crowder chain 92 is provided with crowder chain connecting links 114 which are connected to arm conveyor shaft journal 128. Such connection allows the arm conveyor mounting shaft 130 and thereby the arm conveyor 20 to freely pivot with respect to the arm conveyor shaft journal 128 and crowder drive chain 92. The crowder drive chain connecting links 114 transfer the force imparted by the crowder drive sprocket 98 to the crowder chain 92 to the arm conveyor second end at the interface of the arm conveyor mounting shaft 130 and the arm conveyor shaft journal 128.

Turning to FIG. 9, an alternate embodiment for allowing the crowder drive train 92 to transfer its driving force to the second end of the arm conveyor 20 is shown. In this embodiment, a crowder drive beam 94 is rigidly attached to the arm conveyor shaft journal 128. Such rigid connection may be accomplished for example by welding the crowder drive beam 94 to the arm conveyor shaft journal 128. The crowder drive chain 92 may then be bolted or otherwise rigidly connected to the crowder drive beam 94 by means such as bolts 96, welding, or other known means for making such a rigid connection. In the embodiment shown in FIG. 9, the crowder drive chain 92 imparts its driving force to the crowder drive beam 94 which then imparts the force to arm conveyor journal 128, which in turn imparts the driving force to arm conveyor mounting shaft 130, which transfers the driving force to arm conveyor 20. The arrangement shown in FIG. 9 is preferably duplicated on both the left and right sides of the figure but is only shown on the left side of the figure for purposes of simplification. Likewise, the crowder drive chain connection embodiment shown in FIG. 8 is also preferably duplicated on the other side of the arm conveyor 20.

It will be appreciated that rather large forces may need to be imparted to the arm conveyor 20 to drive it into the exposed earth face 7 as shown in FIG. 5, and, therefore, the crowder embodiment shown and described herein may be replaced with other drive mechanisms more suitable for the particular application at hand.

It will be appreciated that the arm conveyor 20 may be configured to slew about the discharge point with respect to first discharge conveyor 30 (or vice versa). For example, in referring to FIG. 11, wheels 122 and rail 112 could be replaced with a caster wheel arrangement allowing the arm conveyor 20 to pivot on a flat bearing surface with respect to first discharge conveyor 30. Alternately, turning to FIG. 9, a slew ring could be disposed between carriage mounting bracket 126 and arm conveyor shaft journal 128 thereby allowing the arm conveyor 20 to slew about the bogies 120 allowing slewable motion of the arm conveyor 20 with respect to the first discharge conveyor 30. Such a combination would allow the arm conveyor 20 to perform the motions of luffing, translating, and slewing with respect to the first discharge conveyor 30. Such motions provide an extensive range of movement of the arm conveyor 20.

Additional positional control of the arm conveyor 20 may be achieved by moving the boom 60. In viewing the sequential steps shown in FIGS. 3 through 7, it will be observed that the positioning of the earth remover 40 is accomplished in these figures solely by use of the arm positioner cable 66, the bucket positioner 80, and the crowder 90. During the cycles shown in FIGS. 3 through 7, the boom 60 is shown as not moving. As shown in FIG. 1, the boom is anchored to the chassis 12 of the excavator by boom cable anchor point 68. It will be appreciated however that boom cable anchor point 68 could be replaced with a winch, and boom support cable 64 could be adjusted in length. This would affect the beginning and end positions of the arm conveyor 20 and provide a different trajectory along the exposed face 7 of the area being mined than that shown in FIG. 1. Providing such a different trajectory may be desirable where for example significant sloughing of the material from the face of the mine will occur where a very steep angle of excavation is used. Further, it may be desirable to perform surface grading with the apparatus of the invention, not for the express purpose of removing material but for the purpose of grading for subsequent uses of the area. In such a case it would be desirable to perhaps lower the boom 60 so that a path along a relatively shallow angle results from moving the first end of the arm conveyor 20 through its range of motions as limited by the length of the arm positioner cable 66.

The Earth Remover

The apparatus of the present invention may be used in a variety of different applications. It may be desirable for example to use the apparatus as an excavator in which case the earth remover 40 will preferably be a bucket-type arrangement as shown in most of the figures herein. However, the bucket could be replaced with a large grinder if for example the exposed earth face consisted of rock or other material not compatible with bucket-type excavators. It will be the application which effects the selection of the earth remover which is fitted to the first end of the arm conveyor 20.

In yet additional embodiments of the invention, the apparatus fitted to the end of the arm conveyor which is distal from the discharge end of the arm conveyor could be fitted with apparatus which is not properly described as an earth remover. For example, the first end of the arm conveyor could be fitted with a hopper or material receiver which receives material from sources such as a conventional bucket excavator, conveyors, or other material sources. The apparatus could be configured with such a material receiver in the two conveyor embodiment to transfer material from a variety of receiving points to a variety of discharge points. When configured with a material receiver in the three conveyor embodiment described herein, the apparatus can be used to receive material from a discontinuous source and discharge it in a continuous manner to an ancillary receiving point.

By way of example only, a single embodiment of an apparatus which may be fitted to the material receiving end of the first or arm conveyor will be described in detail.

Figure 3:
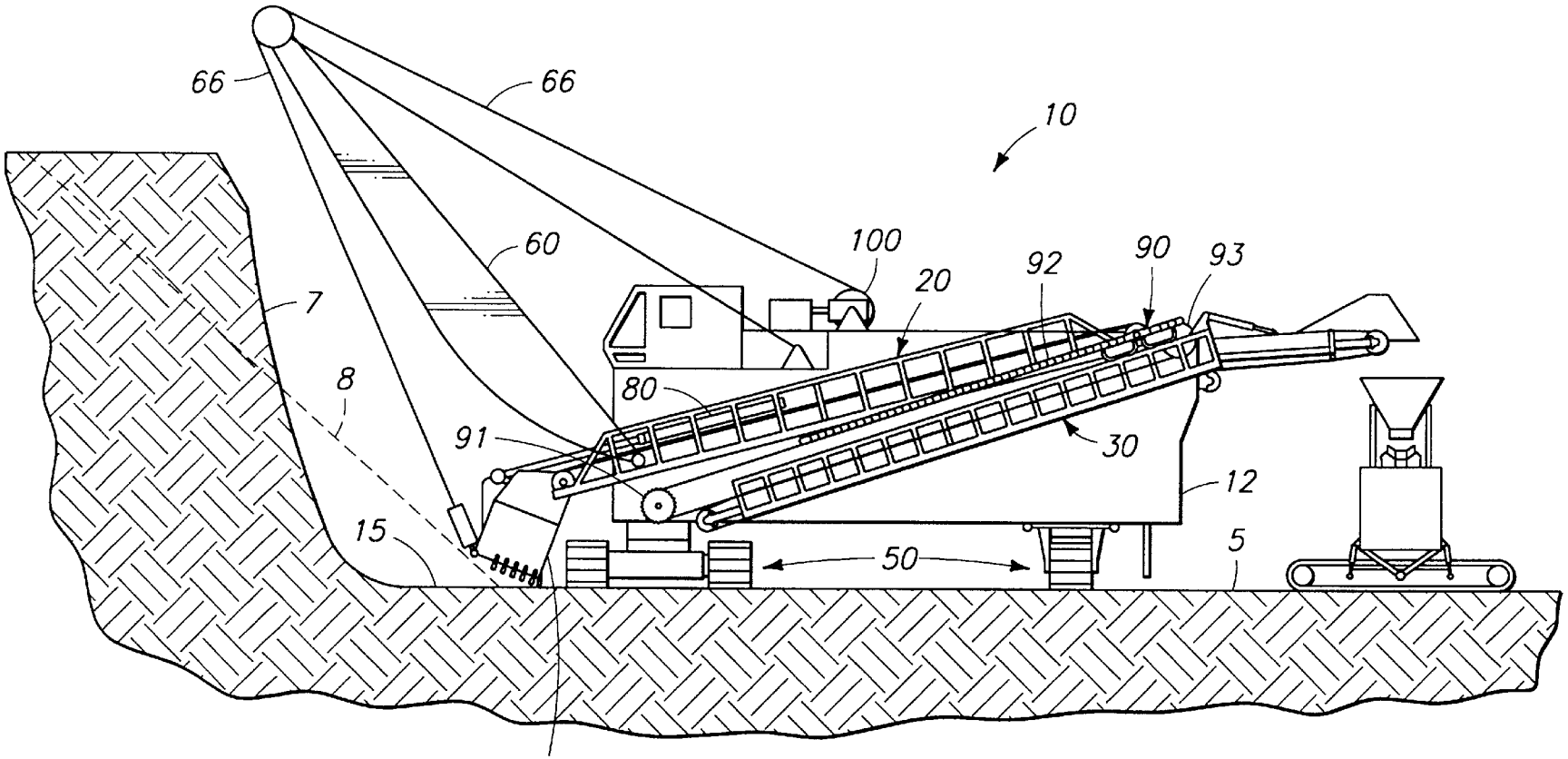
FIG. 3 is a first sequential drawing showing the excavator of the present invention ready to begin its first sequential step in an excavation process.

The bucket which is shown in the embodiment described herein is shown in detail in FIG. 13. The bucket 40 shown herein is provided with bucket lower teeth 84 which may be used for grating or removing material below grade as is shown in FIGS. 3 and 4. The bucket lower teeth are also used in a ripping mode to remove earthen material from the exposed earth face as shown in FIG. 5.

The bucket 40 may further be provided with bucket side teeth 82 which aid in loosening earthen material from the exposed earth face 7 as shown in FIG. 5. Material removed by the bucket teeth 82 and 84 falls into main bucket receiving area 86. Material in main bucket receiving area 86 passes through the throat 88 of the bucket and may be conditioned by breaker 104 which is used to break large portions of the earthen material into smaller pieces which may be more easily handled by the conveyor. Throat 88 and breaker 104 may also work in conjunction to regulate the rate of flow of material onto the arm conveyor belt 22. Breaker 104 is known in the art and may be powered by chain drive or separate electric motor or other means known in the art.

Operation of the Apparatus

It will be appreciated that the apparatus as described in its various embodiments may be operated in a variety of different methods. For example, the apparatus could comprise a stationary frame supporting the first and second conveyors, the first conveyor being fed by hopper from an ancillary conveyor or dump trucks and the like. Alternately, the apparatus may operate more in the manner of a conventional shovel excavator having an upper body which slews about a lower body. In variation on the shovel operating embodiment, the apparatus could comprise the three conveyor embodiment shown in FIG. 10, having the apparatus slewing about the second movement means 146. Such operation would more resemble a traditional shovel excavator but would provide the benefit of a continuous rate of flow of the excavative material from the third conveyor belt versus the discontinuous material flow rate generated by present shovel excavators. By way of example, one particular method of operating the excavator of the present invention will now be described in detail, and in particular with respect to sequential FIGS. 3 through 7.

In open cast or open pit mining operations, an excavator will typically move along the exposed face of the open cast mine removing material until it has reached the end of the face at which point the excavator will reverse direction and may remove material in the reverse direction or may return to the starting point and begin removing material at the first end of the exposed face. Between the time that the excavator has excavated material from the face of the mine and the time to which it returns to that location again, the earthen material may slump down to the position shown by the dashed line 8 in FIG. 3. The angle of the line with respect to the ground 5 is known as the natural angle of repose and varies depending upon the type of material, the moisture content, and ambient conditions such as wind and rain. Where material has slumped down onto the leach pad base 15, it is desirable to first remove such material and perhaps also remove an additional amount of material from the surface to provide improved leaching characteristics for the leach pad base 15. The step shown in moving from FIG. 3 to FIG. 4 is best known as the "re-engagement stage," as this is the stage where the bucket is repositioned to engage the exposed face 7 of the mine. Where significant sloughing of the face has occurred as shown in FIG. 3, a certain filling of the bucket with earthen material will occur in moving from stage 1 (FIG. 3) to stage 2 (FIG. 4). Comparing FIGS. 3 and 4, it will be seen that in moving from the first position to the second position, the bucket is rotated approximately 80 degrees, during which time the front end of the arm conveyor is also elevationally lowered slightly. Further, the arm conveyor 20 is driven in a forward direction by the crowder 90. Upon re-engaging the base of the exposed face as shown in FIG. 4, the bucket is nearly horizontal with the ground.

In moving from FIG. 4 to FIG. 5, the arm conveyor moves to the stage in the cycle known as the "initial bucket fill" or "initial cut." During this stage the bucket 40 rotates on the arm conveyor 20, coming to a nearly vertical position with respect to the exposed earth face 7. During this movement, the crowder drive 90 drives the arm conveyor 20 in a forward direction while the arm positioner cable 66 begins to lift the first end of the arm conveyor in a vertical direction. During the initial cut stage, the portion of material indicated by B in FIG. 5 is removed. It will be appreciated then that during the initial bucket fill, three distinct motions are occurring: bucket rotation, arm conveyor elevation, and arm conveyor translational motion from the crowder drive. It will also be seen by comparing the bucket positions in FIGS. 4 and 5 that it is primarily when the bucket reaches the position shown in FIG. 5 that material starts to move from the bucket onto the arm conveyor belt 22. Arm conveyor belt 22 moves material along arm conveyor 20 to the second end of the arm conveyor where it is then deposited onto the first discharge conveyor 30. Material may be moved on arm conveyor 30 to be either deposited into material receiving station 70 as shown in FIG. 5 or in the opposite direction to be deposited into surge pocket 150 as shown in FIG. 10.

In the next stage of the cycle, the bucket 40 moves from the position shown in FIG. 5 to that shown in FIG. 6. The dotted line C in FIG. 5 shows the trajectory of the bucket as it moves between these two positions. In so moving, the earth remover 40 removes the earthen material in the zone E shown in FIG. 6. During this portion of the cycle, very little bucket positioning occurs until near the top of the exposed earth face. At that point the bucket is rotated slightly downward to provide a slightly tapered top to reduce initial sloughing of the exposed face. This downward rotation of about 20 to 30 degrees will typically result in heaping of the bucket prior to topping out of the cut. Since no material is deposited in the bucket during the retraction step, it is advantageous to overfill the bucket prior to retraction so that the bucket has material it that may process during the retraction step when no new material is being added to the bucket. Such allows a more constant flow of material from the bucket onto the arm conveyor belt 22.

During the cut stage of the cycle shown between FIGS. 5 and 6, the arm conveyor is continued to be driven in a forward direction by the crowder 90 which not only aids in proper positioning of the bucket but provides a force against the face of the cut which is useful and may be necessary in causing material to be removed from the face.

In the next stage of the cycle, the bucket moves from the position shown in FIG. 6 to that shown in FIG. 3. FIG. 7 shows an intermediate position of the bucket during this step. This step in the process is known as the "recovery step." That is, the bucket is recovering its position from the top of the face to the bottom of the face where sloughed material may need to be removed as shown in FIG. 3. During this time, the bucket continues to empty itself onto the arm conveyor belt 22. The bucket maintains itself in its generally upward direction during most of the recovery step while the crowder drive reverses and pulls the second end of the arm conveyor 20 back towards the rear of the excavator 10. Once the bucket has sufficiently cleared the exposed face 7, it begins to rotate in a generally downward direction until it is at the position shown in FIG. 3. While the second end of the arm conveyor is being retracted by the crowder 90, the first end of the arm conveyor is being elevationally lowered by arm position control cable 66 working in conjunction with arm conveyor position winch 100. Also during this time, the excavator 10 may move in a translational direction along the exposed face 7 of the area being excavated. Such traversing is known as "traverse index travel." That is, the excavator translates along the exposed face a given amount which is typically approximately two-thirds the width of the bucket. Such index travel may be automatically controlled or may be operator controlled.

Once the excavator has reached the end of the face, the excavator will need to be advanced toward the exposed face so that it is positioned to begin cutting the zone indicated by F in FIG. 7, following which zone G will then be excavated.

Method of the Invention

The method of the present invention comprises the steps of removing earthen material from a first location and transporting it to a second location via a combination of material transports. An implementation of the method may be accomplished using the apparatus described herein. The material transports described in the method may be conveyors or other material transferring apparatus which operate in an essentially longitudinal material transporting manner.

More particularly, the method comprises the steps of removing material from an exposed material face by moving a material remover along the material face, moving the removed material onto a first material transport at a first material receiving point, transporting the material on the first material transport to a first material discharge point, discharging the material onto a second material transport, and moving the material along the second material transport to a discharge point on the second material transport. As the earth remover is moved relative to the exposed material face, the material discharge point of the first material transport moves relative to the material receiving point on the second material transport. The movement of the discharge point is responsive to movement of the earth remover.

The method may further comprise the steps of collecting material discharged from the second material transport into a material collector, and then discharging the collected material from the material collector onto a third material transport at an essentially constant volume flow rate.

More particularly, the movement of the discharge point of the first material transport with respect to the material receiving point on the second material transport is such that the first material transport discharging point moves rectilinearly along the second material transport. More particularly, the method may include the step of supporting the discharge point of the first material transport about either side of the receiving point of the second material transport.

The method may further comprise the method of slewing the first material transport relative to the second material transport. The slewing axis is preferably a vertical axis containing both the first material transport discharge point and the second material transport receiving point. That is, the end of the first material transport containing the material remover may be slewed in a back and forth direction while the first material transport discharge point is maintained essentially fixed with respect to the second material transport receiving point. Following the slewing motion, or even during the slewing motion, the first material discharge point may be relocated rectilinearly along the second material transport. Note that both slewing and rectilinear translation of the first material transport may be performed at the same time without detracting from the general scope of the method.

The method of the present invention may further comprise the step of pushing the first material transport, and hence the material remover, against the exposed material face while moving the material remover along the material face. Such is accomplished by exerting a force against the first material transport. More particularly, the force is applied at the end of the first material transport, that is, the end at which the first material transport discharge point is located.

In a specific embodiment of the present invention, the method consists of the steps of: engaging an exposed material face with a material remover which is attached to a first material transport; moving the first material transport and hence the material remover in a generally upward and slightly forward direction; moving the second end of the longitudinal first material transport in a forward direction coincident with the longitudinal axis of a second material transport, wherein the second material transport is positioned to receive material discharging from the first material transport; continuing to elevate the material remover while generally urging the material remover in a forward direction by exerting a force on the second end of the first material transport as the first material transport translates along the generally longitudinal axis of the second material transport; and withdrawing the material remover from the exposed material face and retracting the first material transport along the longitudinal axis of the second material transport while elevationally lowering the first end of, and hence the material remover attached to, the first material transport.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An earthen material conveyor system comprising first and second longitudinally elongated conveyors having respective ends, one of the first conveyor ends comprising a discharge end which is positioned over the second conveyor to enable transfer of earthen material from the first conveyor to the second conveyor, the first conveyor being movably supported upon the second conveyor to enable selective and moveable longitudinal positioning of the first conveyor discharge end at different longitudinal locations along the second conveyor.

2. The conveyor system of claim 1 wherein said first conveyor is rollably supported upon said second conveyor.

3. The conveyor system of claim 1 wherein said first conveyor is rollably supported upon rails mounted upon said second conveyor.

4. The conveyor system of claim 1 and further comprising a supporting mechanism between the discharge end of the first conveyor and the second conveyor, said supporting mechanism being controllably driven to enable selective longitudinal positioning of the first conveyor discharge end relative to the second conveyor.

5. The conveyor system of claim 1 further comprising an earth remover mounted to deposit earth materials upon the first conveyor.

6. The conveyor system of claim 1 wherein the discharge end of the first conveyor is pivotally supported over the second conveyor to slew relative thereto.

7. The conveyor system of claim 1 and further comprising a supporting mechanism between the discharge end of the first conveyor and the second conveyor, said supporting mechanism being controllably driven to enable selective longitudinal positioning of the first conveyor discharge end relative to the second conveyor;

and wherein the first conveyor is mounted for controlled movement at a position distal from the discharge end thereof.

8. A material transfer machine for moving material from a first location to a second location, comprising:

a chassis;

a first material transport and a second material transport, said first material transport and said second material transport supported by said chassis, said first material transport configured to move with respect to said second material transport, wherein said first material transport has a first end and a second end, said first material transport first end positioned with respect to said second material transport to allow said material to be discharged from said first material transport onto said second material transport;

a material remover, said material remover disposed at said second end of said first material transport and configured to deposit material removed by said material remover onto said first material transport; and a first material transport drive connected to said first material transport and configured to move said first end of said first material transport with respect to said second material transport and said chassis;

a first material transport second end positioner configured to elevationally position said second end of said first material transport, said first material transport second end positioner supported by said chassis;

wherein said first end of said first material transport is constrained to move in a direction along the length of said second material transport.

9. The material transfer machine of claim 8 wherein the first material transport second end positioner includes a boom which suspends said first material transport.

10. The material transfer machine of claim 8 and further comprising:

a third material transport; and a surge hopper, said surge hopper being positioned to receive material from said second material transport and to discharge said material onto said third material transport.

11. The material transfer machine of claim 10 wherein said third material transport and said surge hopper are supported by said chassis.

12. The material transfer machine of claim 8 further comprising a material remover positioner configured to move said material remover with respect to said second end of said first material transport, said material remover positioner supported by said chassis.

13. A material transfer machine for moving material from a first location to a second location, comprising:

a chassis;

a first material transport and a second material transport, said first material transport and said second material transport supported by said chassis, said first material transport configured to move with respect to said second material transport, wherein said first material transport has a first end and a second end, said first material transport first end positioned with respect to said second material transport to allow said material to be discharged from said first material transport onto said second material transport;

a material remover, said material remover disposed at said second end of said first material transport and configured to deposit material removed by said material remover onto said first material transport; and a first material transport drive connected to said first material transport and configured to move said first end of said first material transport with respect to said second material transport and said chassis;

wherein said first material transport is configured to slew about said second material transport at said first end of said first material transport.

14. The material transfer machine of claim 13 wherein said first end of said first material transport is constrained to move in a direction along the length of said second material transport.

15. An excavator comprising:

a chassis;

an arm conveyor and a first discharge conveyor, said arm conveyor and said first discharge conveyor supported by said chassis, said arm conveyor moveable with respect to said first discharge conveyor, wherein said arm conveyor has a first end and a second end, said arm conveyor first end positioned with respect to said first discharge conveyor to allow material to be discharged from said arm conveyor onto said first discharge conveyor, said arm conveyor further comprising:

a material remover, said material remover disposed at said second end of said arm conveyor; and an arm conveyer belt for moving material along said arm conveyor;

wherein said material remover is configured such that material removed by said material remover is deposited onto said arm conveyor belt;

an arm conveyor drive connected to said arm conveyor to cause movement of said first end of said arm conveyor with respect to said first discharge conveyor and said chassis; and an arm conveyor second end positioner for elevationally positioning said second end of said arm conveyor, said arm conveyor second end positioner supported by said chassis;

a second discharge conveyor having a first end and a second end; and a surge pocket positioned to receive material from said first discharge conveyor and to discharge said material onto said first end of said second discharge conveyor;

a moving mechanism connected to said second end of said second discharge conveyor to allow movement of said excavator with respect to a surface on which said second end of said second discharge is resting.

16. The excavator of claim 15 further comprising a chassis movement mechanism connected to said chassis to allow movement of said excavator with respect to a surface on which said excavator is resting.

17. The apparatus of claim 16 further comprising a mounting platform disposed between said chassis and said chassis movement mechanism, said mounting platform further comprising a pivoting mechanism configured to allow said chassis to pivot with respect to said chassis movement mechanism.

18. The apparatus of claim 16 wherein said chassis movement mechanism is independently steerable.

19. The excavator of claim 15 wherein said second discharge conveyor and said surge pocket are connected to said chassis.

20. The excavator of claim 15 wherein said second discharge conveyor is configured to slew with respect to said first discharge conveyor.

21. The excavator of claim 15 wherein said arm conveyor second end positioner comprises:

a boom, said boom having a first end connected to said chassis and a second end distal from said first end;

a cable connected to said arm conveyor at a cable arm connection point, said cable being supported by said boom at a position distal from said first end, such that said elevational position of said arm conveyor may be effected by the length of cable disposed between said boom and said cable arm connection point; and a cable take-up and deployment mechanism for causing the length of cable disposed between said boom and said cable arm connection point to shorten and lengthen in response to actuation thereof.

22. The excavator of claim 15 wherein said material remover comprises an excavator bucket.

23. The excavator of claim 22 wherein said excavator bucket is configured to move in rotational movement about said second end of said arm conveyor.

24. The excavator of claim 15 further comprising an overlay conveyor, said overlay conveyor disposed proximate to said arm conveyor so as to form a material channel therebetween such that said material channel may restrict the amount of material passing therethrough and onto said first discharge conveyor.

25. The excavator of claim 15 wherein:

said first discharge conveyor is generally longitudinal in shape defining longitudinal sides on either side of said first discharge conveyor;

said excavator further comprises longitudinal bearing members along each side of said first discharge conveyor belt; and said arm conveyor comprises bearing elements for supporting said first end of said arm conveyor on said longitudinal bearing members.

26. The excavator of claim 25 wherein said longitudinal bearing members comprise rails and wherein said bearing elements comprise wheels which rest on and move along said rails.

27. Method for moving earthen material from a first location having an exposed material face to a second location, comprising:

removing said material from said exposed material face with a material remover by moving said material remover along said material face;

moving said removed material onto a first material transport at a first material receiving point;

conveying said material on said first material transport to a first material discharge point;

discharging said material onto a second material transport at a second material receiving point; and discharging said material from a first end of said second material transport;

wherein said first material discharge point moves in response to movement of said material remover to effectively vary said second material receiving point;

slewing said first material discharge point about an axis located at said second material receiving point.

28. The method of claim 27 further comprising the steps of:

collecting said removed material in a material collector;

discharging said collected material from said material collector onto a third material transport at an approximately constant volume flow rate.

29. The method of claim 27 wherein said first material discharge point moves rectilinearly along said second material transport.

30. The method of claim 27 further comprising the step of pushing said material remover against said exposed material face while moving said material remover along said material face.

31. The method of claim 27 wherein said material remover is moved along said exposed material face in a generally vertical motion.

32. The method of claim 27 wherein said material remover is moved along said exposed material face in a generally horizontal motion.

33. An excavator comprising:

a chassis;

an arm conveyor and a first discharge conveyor, said arm conveyor and said first discharge conveyor supported by said chassis, said arm conveyor moveable with respect to said first discharge conveyor, wherein said arm conveyor has a first end and a second end, said arm conveyor first end positioned with respect to said first discharge conveyor to allow said material to be discharged from said arm conveyor onto said first discharge conveyor, said arm conveyor further comprising:

a material remover, said material remover disposed at said second end of said arm conveyor; and an arm conveyer belt for moving material along said arm conveyor;

wherein said material remover is configured such that material removed by said material remover is deposited onto said arm conveyor belt;

an arm conveyor drive connected to said arm conveyor to cause movement of said first end of said arm conveyor with respect to said second conveyor and said chassis; and an arm conveyor second end positioner for elevationally positioning said second end of said arm conveyor, said arm conveyor second end positioner supported by said chassis and including:

a boom having a first end connected to said chassis and a second end distal from said first end;

a cable connected to said arm conveyor at a cable arm connection point, said cable being supported by said boom at a position distal from said first end, such that said elevational position of said arm conveyor may be effected by the length of cable disposed between said boom and said cable arm connection point; and a cable take-up and deployment mechanism for causing the length of cable disposed between said boom and said cable arm connection point to shorten and lengthen in response to actuation thereof.

34. An excavator comprising:

a chassis;

an arm conveyor and a first discharge conveyor, said arm conveyor and said first discharge conveyor supported by said chassis, said arm conveyor moveable with respect to said first discharge conveyor, wherein said arm conveyor has a first end and a second end, said arm conveyor first end positioned with respect to said first discharge conveyor to allow said material to be discharged from said arm conveyor onto said first discharge conveyor, said arm conveyor further comprising:

a material remover, said material remover disposed at said second end of said arm conveyor; and an arm conveyer belt for moving material along said arm conveyor;

wherein said material remover is configured such that material removed by said material remover is deposited onto said arm conveyor belt;

an arm conveyor drive connected to said arm conveyor to cause movement of said first end of said arm conveyor with respect to said first discharge conveyor and said chassis; and an arm conveyor second end positioner for elevationally positioning said second end of said arm conveyor, said arm conveyor second end positioner supported by said chassis;

an overlay conveyor, said overlay conveyor disposed proximate to said arm conveyor so as to form a material channel therebetween such that said material channel may restrict the amount of material passing therethrough and onto said first discharge conveyor.

35. Method for moving earthen material from a first location having an exposed material face to a second location, comprising:

removing said material from said exposed material face with a material remover by moving said material remover along said material face;

moving said removed material onto a first material transport at a first material receiving point;

conveying said material on said first material transport to a first material discharge point;

discharging said material onto a second material transport at a second material receiving point;

supporting the first material transport upon the second material transport to allow relative movement therebetween;

discharging said material from a first end of said second material transport;

wherein said first material discharge point moves in response to movement of said material remover to effectively vary said second material receiving point.

36. The method of claim 35 further comprising the steps of:

collecting said removed material in a material collector;

discharging said collected material from said material collector onto a third material transport at an approximately constant volume flow rate.

37. The method of claim 35 wherein said first material discharge point moves rectilinearly along said second material transport.

38. The method of claim 35 further comprising the step of slewing said first material discharge point about an axis located at said second material receiving point.

39. The method of claim 35 further comprising the step of pushing said material remover against said exposed material face while moving said material remover along said material face.

40. The method of claim 35 wherein said material remover is moved along said exposed material face in a generally vertical motion.

41. The method of claim 35 wherein said material remover is moved along said exposed material face in a generally horizontal motion.

* * * * *

UNITED STATES PATENT AND TRADEMARK OFFICE

CERTIFICATE OF CORRECTION

PATENT NO. : 6,185,847 B1
DATED : February 13, 2001
INVENTOR(S) : Russell et al.

It is certified that error appears in the above-identified patent and that said Letters Patent is hereby corrected as shown below:

Column 8,
Line 63, after "which", delete [a] and insert -- are --.

Column 12,
Line 55, after "material", delete [it that] and insert -- that it --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*